US007465150B2

(12) United States Patent
Ahmad

(10) Patent No.: US 7,465,150 B2
(45) Date of Patent: Dec. 16, 2008

(54) COOLED GAS TURBINE GUIDE BLADE FOR A GAS TURBINE, USE OF A GAS TURBINE GUIDE BLADE AND METHOD FOR OPERATING A GAS TURBINE

(75) Inventor: Fathi Ahmad, Kaarst (DE)

(73) Assignee: Siemens Aktiengesellachaft, Munich (DE)

( * ) Notice: Subject to any disclaimer, the term of this patent is extended or adjusted under 35 U.S.C. 154(b) by 63 days.

(21) Appl. No.: 11/479,183

(22) Filed: Jun. 30, 2006

(65) Prior Publication Data

US 2007/0116563 A1 May 24, 2007

(30) Foreign Application Priority Data

Jul. 1, 2005 (EP) ..... 05014377

(51) Int. Cl.
*F01D 9/06* (2006.01)
*F01D 25/10* (2006.01)
*F01D 25/12* (2006.01)

(52) U.S. Cl. ..... 415/116; 415/115; 415/175; 415/176; 415/178; 416/96 R; 416/97 R; 60/39.093

(58) Field of Classification Search ..... 415/115, 415/116, 175–178; 416/39, 95, 96 R, 96 A, 416/97 R; 60/39.093; 244/134 D
See application file for complete search history.

(56) References Cited

U.S. PATENT DOCUMENTS 2,004,777 A 6/1935 Bassler
2,402,770 A * 6/1946 Poekel ..... 244/134 D
2,540,472 A 2/1951 Boyd et al.
3,997,758 A 12/1976 Patel
4,200,784 A 4/1980 Albaric et al.
5,201,847 A * 4/1993 Whidden ..... 415/177
5,281,091 A * 1/1994 Dooley et al. ..... 415/178
7,131,815 B2 * 11/2006 Allford et al. ..... 415/160
2007/0147996 A1 * 6/2007 Campbell et al. ..... 416/95

FOREIGN PATENT DOCUMENTS

DE 32 28 799 A1 3/1983
EP 1 156 189 A1 11/2001
EP 1 505 256 A2 2/2005
JP 60242545 A 2/1985

* cited by examiner

*Primary Examiner*—Christopher Verdier

(57) ABSTRACT

Described is a cooled gas turbine guide blade for a gas turbine, with a hollow blade profile which comprises an onflow edge onto which a working medium is capable of flowing, and with, for guiding a cooling medium, an onflow edge duct running inside the blade profile along the onflow edge. Furthemore, to the use of such a gas turbine guide blade and to a method for operating a gas turbine with an abovementioned gas turbine guide blade. In order to provide a gas turbine guide blade with an increased lifetime by means of the invention, it is proposed that, in the onflow edge duct, an electrical heating element be provided, which extends approximately completely over the entire length of the onflow edge duct and through which a heating current flows, before the operation of the gas turbine, for the preheating of the gas turbine guide blade.

7 Claims, 2 Drawing Sheets

COOLED GAS TURBINE GUIDE BLADE FOR A GAS TURBINE, USE OF A GAS TURBINE GUIDE BLADE AND METHOD FOR OPERATING A GAS TURBINE

CROSS REFERENCE TO RELATED APPLICATIONS

This application claims the benefits of European Patent application No. 05014377.5 filed Jul. 1, 2005 and is incorporated by reference herein in its entirety.

FIELD OF THE INVENTION

The invention relates to a cooled gas turbine guide blade for a gas turbine, with a hollow blade leaf which comprises an onflow edge onto which a working medium is capable of flowing, and which has, for guiding a cooling medium, an onflow edge duct running inside the blade profile along the onflow edge. The invention relates, furthermore, to the use of such a gas turbine guide blade and to a method for operating a gas turbine having an abovementioned gas turbine guide blade.

BACKGROUND OF THE INVENTION

A cooled turbine guide blade for a gas turbine is known from EP 1 505 256 A2. The turbine guide blade has a leading edge of a blade profile, a hot gas being capable of flowing onto said leading edge. A cooling duct running transversely with respect to the hot gas direction extends inside.

The calculation of the maximum permissible lifetime of gas turbine blades of this type, so as to ensure a fault-free and reliable operation of the gas turbine, is also carried out, taking into account the fatigue lifetime in terms of fatigue strength under short-term vibratory stresses (low-cycle fatigue=LCF). The LCF lifetime is determined on the basis of theoretical models and on the assumption of boundary conditions. After the maximum permissible lifetime is reached, the gas turbine is opened and the gas turbine blades are investigated visually and mechanically for defects, such as, for example, cracks. The investigation is intended to ascertain whether its further use for a next operating interval is possible, without the operation of the gas turbine being put at risk.

The dismantling of the gas turbine is complicated and leads to an undesirable increase in downtime. Furthermore, the investigations are time-consuming and cost-intensive, and therefore there is a general effort to reduce the downtimes of the gas turbine and increase the lifetime of the components used and employed.

SUMMARY OF THE INVENTION

The object of the invention is, therefore, to provide a gas turbine guide blade with an increased lifetime. A further object of the invention is the use of such a gas turbine guide blade and the specification of two methods for operating a gas turbine having a gas turbine guide blade, in order to increase its lifetime.

The object aimed at the gas turbine guide blade is achieved by means of a gas turbine guide blade according to the claims. The invention proposes that the generic gas turbine guide blade has in the onflow edge duct an electrical heating element which extends approximately completely over the entire length of the onflow edge duct.

The invention is based on the recognition that particularly sharply rising or sharply falling temperatures, even what are known as temperature shocks, may give rise to cracks in the blade material and promote, if not even accelerate, the growth of cracks. The rapid temperature changes cause in each case thermal stresses in the blade material which has to withstand many such temperature alternations and stress alternations. On account of an excessively large number of temperature alternations, in particular cold starts of the gas turbine, the blade material suffers fatigue. Under the progressive action of temperature alternations and stress alternations, cracks may arise and grow further. If the cracks overshoot a critical length or if too large a number of cracks of uncritical length are present within a unit of area, then the component has to be exchanged.

These negative indications occur more frequently, the more frequently the blade material acted upon by hot gas is exposed to rapid temperature changes, and the greater the temperature differences to be withstood in each case are.

Particularly during the cold start of the gas turbine and while the gas turbine is being run down, the highest temperature differences occur in the components acted upon by hot gas.

However, the unplanned shutdown of the gas turbine under full load in the event of a critical fault has the greatest adverse influence on the lifetime of the turbine blade. This situation, designated as a trip, significantly reduces the lifetime of the components acted upon by hot gas and therefore also that of gas turbine blades, since their material has at these moments to withstand particularly high temperature gradients and/or temperature fluctuations.

This is where the invention comes in. In a preferably stationary gas turbine, the lifetime of the gas turbine guide blade is significantly increased in that, to achieve the object aimed at the method, according to the claims, the gas turbine guide blade is preheated before the cold start of the gas turbine. For this purpose, the gas turbine blade has in the onflow edge duct a heating element which extends completely over the length of the blade profile. Even before the firing of the gas turbine, that is to say during preheating, the electrical heating element through which an electrical current flows warms up comparatively slowly the gas turbine guide blade which at the beginning is at room temperature, so that the temperature-induced thermal stresses in the blade material can be kept correspondingly low. The temperature rise takes place comparatively slowly, not quickly or abruptly, as in the previous starting, that is to say firing, of the gas turbine. With the firing of the gas turbine, the heating of the gas turbine guide blade is established.

Likewise, to achieve the object aimed at the method, according to the claims, the lifetime of the gas turbine guide blade can be increased if the reheating of the gas turbine guide blade is commenced when the firing of the gas turbine is shut down, planned or unplanned in the event of a full-load shutdown (trip). Since the gas turbine guide blade is heated to its maximum permissible operating temperature during the operation of the gas turbine, a directed and controlled lowering of the temperature of the blade material can be achieved by means of the reheating. As a result, the temperature lowering duration is appreciably prolonged, as compared with the previous normal cooling of the gas turbine guide blade, so that the material stresses occurring due to the temperature lowering are comparatively minor.

Since a reduction in thermal stresses can be achieved in both methods, the occurrence of cracks in the blade material can be further delayed and the growth of cracks slowed, as compared with previous gas turbine blades from the prior art. The methods which thus take care of the material lead to a significant rise in fatigue strength under short-time vibratory stresses and to a prolongation of the gas turbine guide blade lifetime guaranteed to be uncritical in terms of faults. A gas turbine equipped with the gas turbine blades and/or operated according to the methods can be employed reliably and in a fault-free way for longer, thus having a cost-diminishing effect because checking investigations are shifted further back in time.

Since the gas turbine blades of the first and the second turbine stage have to withstand the highest operating temperatures, the greatest temperature differences also occur in these gas turbine blades. The operating temperatures lie in such high temperature ranges that these gas turbine blades, in particular, are cooled. The invention is therefore particularly suitable for cooled gas turbine blades. By contrast, uncooled gas turbine blades are subject to lower temperature differences, so that the described influence of the temperature changes between hot (=operating temperature of the component) and cold (=ambient temperature) is less.

Advantageous embodiments are specified in the subclaims.

A particularly uniform warming of the blade leaf of the gas turbine guide blade can be achieved if the electrical heating element bears against the duct wall of the onflow edge duct or is at least partially integrated in the duct wall. This particularly beneficial thermal coupling of heating element and duct wall leads to a low-loss heating of the material of the gas turbine guide blade.

In order to ensure a particularly uniformed distribution of the heat energy radiated by the heating element into the blade material, the heating element is designed as a helical heating coil. The heating coil is known and is available cost-effectively.

In order to achieve a sufficient warming of the gas turbine guide blade before the starting of the gas turbine, the thermal output supplied is increased during the heating operation. This leads, during the preheating, to a permanent and continuous warming of the blade material up to a temperature value, of which the difference from the operating temperature of the gas turbine guide blade is low, as compared with the difference between the ambient temperature and operating temperature. As a result, material stresses occurring in the blade material build up slowly and therefore carefully in terms of the material. When firing subsequently commences with the starting of the gas turbine, the remaining temperature rise is low. Temperature shocks are thus avoided. It is also possible, by means of the electrical heating element, to maintain the gas turbine guide blade at a "warm" standby temperature lying near operating temperature, in order to achieve a shortened starting phase.

During the reheating phase, the thermal output supplied to the gas turbine guide blade is lowered continuously, in order to bring about a comparatively slow lowering of the temperature of the blade material, thus leading to reduced thermal material expansions and stresses.

Overall, by means of the invention, the LCF fatigue of gas turbine guide blades can be reduced, thus having a positive effect on their lifetime and bringing about a reduction in the operating risk of a gas turbine equipped with such gas turbine blades.

BRIEF DESCRIPTION OF THE DRAWINGS

The invention is explained with reference to figures in which.

DETAILED DESCRIPTION OF THE INVENTION

Figure 1:
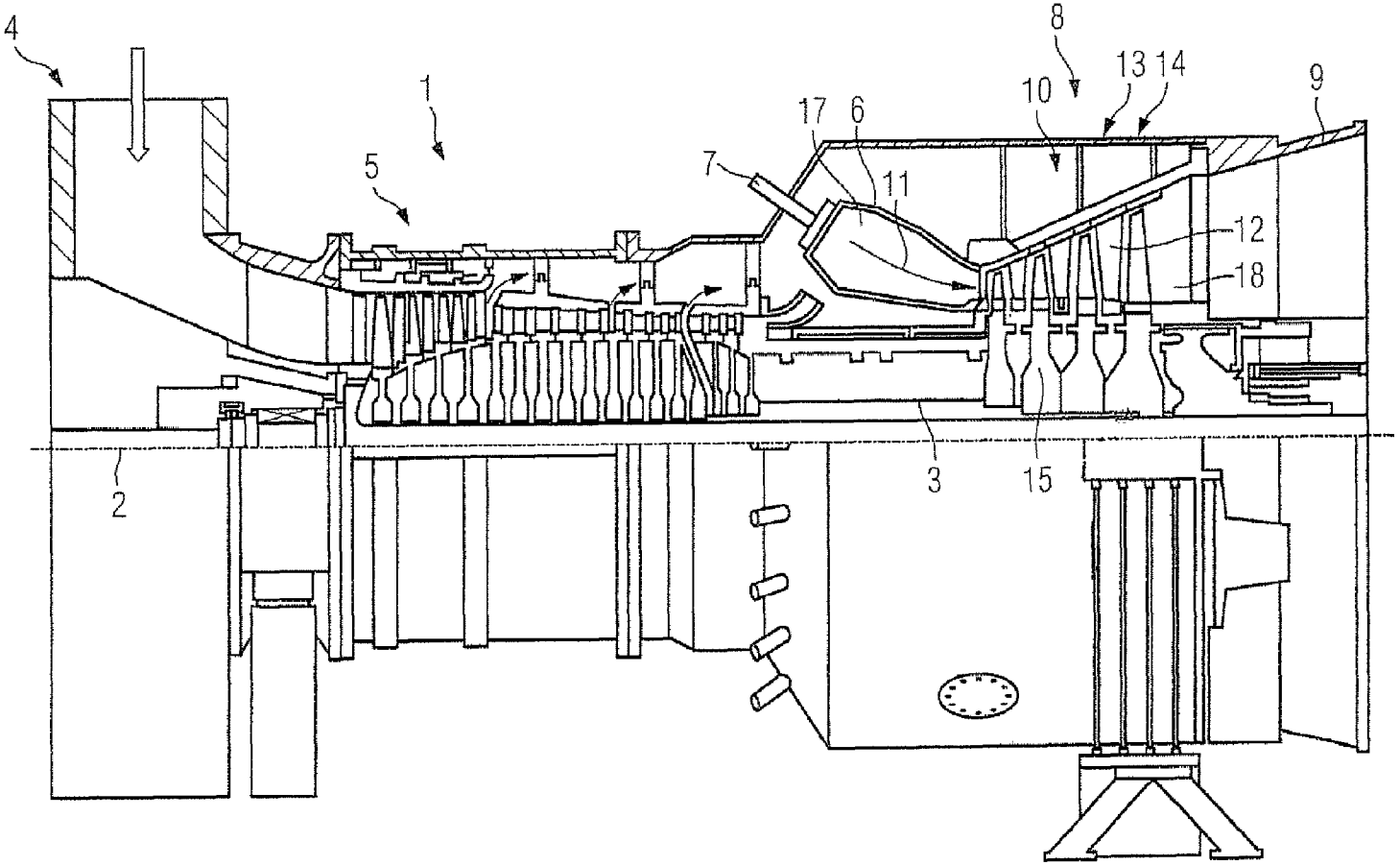
FIG. 1 shows a gas turbine in a part longitudinal section.

FIG. 1 shows a gas turbine 1 in a part longitudinal section. It has, inside, a rotor 3 which is rotary-mounted about an axis of rotation 2 and which is also designated as a turbine rotor. An intake casing 4, a compressor 5, a toroidal annular combustion chamber 6 with a plurality of burners 7 arranged rotationally symmetrically with respect to one another, a turbine unit 8 and an exhaust casing 9 succeed one another along the rotor 3. The annular combustion chamber 6 forms a combustion space 17 which communicates with an annular hot-gas duct 18. There, four turbine stages 10 connected in series form the turbine unit 8. Each turbine stage 10 is formed from two blade rings. As seen in the flow direction of a hot gas 11 generated in the annular combustion chamber 6, a guide blade row 13 is followed in the hot-gas duct 18 in each case by a row 14 formed from moving blades 15. The guide blades 12 are fastened to the stator, whereas the moving blades 15 of a row 14 are attached to the rotor 3 by means of a turbine disk. A generator or a working machine (not illustrated) is coupled to the rotor 3.

Figure 2:
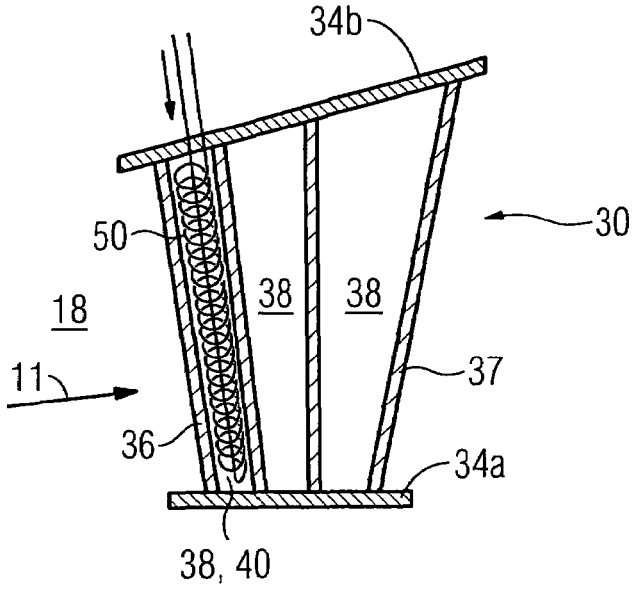
FIG. 2 shows a gas turbine guide blade with a helical heating coil.

A gas turbine guide blade 30 according to the invention is illustrated in longitudinal section in FIG. 2. The gas turbine blade 30 has a blade profile 32 which extends between two platforms 34. The platforms 34 form the radially outer and inner boundary of the hot-gas duct 18 in which the hot-gas 11 flows when the gas turbine is in operation. The onflow-edge of the blade profile 32 is designed as the onflow edge 36. At the opposite end, the blade profile 32 has a blade trailing edge 37 at which the hot gas 11 flows off.

The blade profile 32 may have a plurality of cavities 38, into which a cooling medium 40, preferably cooling air, supplied by means of the platform 34 can flow and cool the cast turbine blade 30. For cooling, the customary cooling methods, such as convection cooling, baffle cooling and/or film cooling and also effusion cooling, may be employed.

In order to preheat the gas turbine guide blade 30 before the cold start of the gas turbine 1, an electrical heating element 50 is provided in one of the cavities 38, but preferably in the cavity which follows the onflow edge 36, that is to say in the onflow edge duct 40. The heating element 50 extends approximately over the complete length of the onflow edge 36, that is to say from the radially inner platform 34*a* to the outer platform 34*b*.

In order to allow a particularly uniform warming of the gas turbine blade 30, the heating element 50 is designed as a helical heating coil 54.

Figure 3:
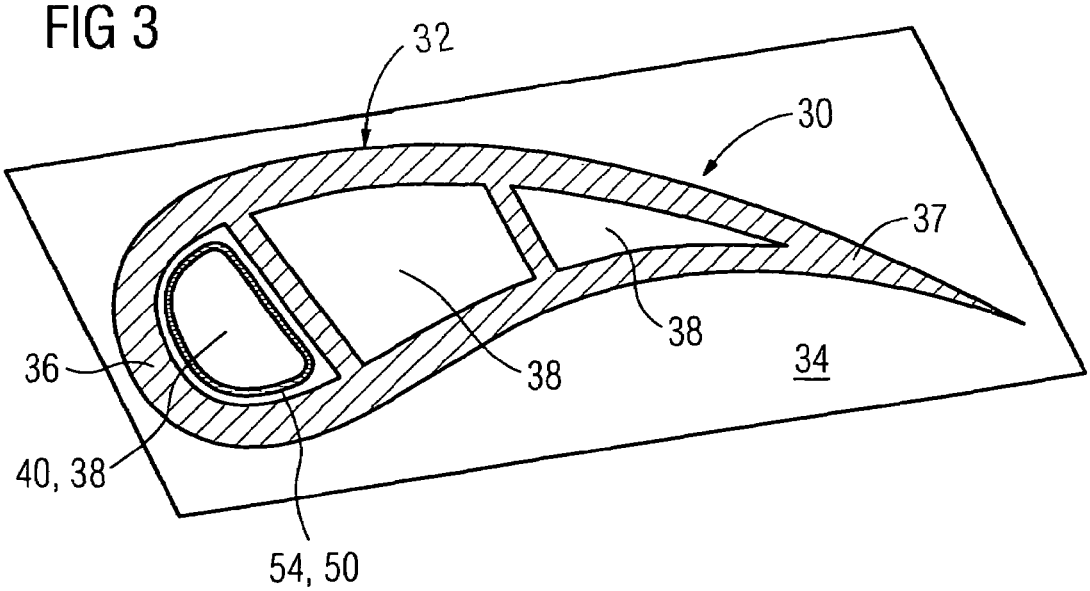
FIG. 3 shows in cross section a gas turbine guide blade according to the invention from FIG. 2.

FIG. 3 shows a cross section through the gas turbine blade 30 according to the invention, as shown in FIG. 2. The onflow edge duct 42 has arranged in it the helical heating coil 54, through which a regulatable electrical heating current can flow in order to preheat or reheat the gas turbine guide blade 30 so as to prolong the lifetime of the latter. The electrical heating current gives rise in the heating coil 54 to heat radiation which, before the operation of the gas turbine 1, warms comparatively slowly the material of the cast gas turbine guide blade 30, preferably the material of the blade profile 32 and of the platform 34, in order to cause the thermomechanical material stresses to grow in an order of magnitude which is uncritical for the LCF lifetime or to cause them to fade away after operation.

By virtue of the preheating or reheating of the gas turbine guide blade 30, particularly sharp temperature fluctuations, what are known as temperature shocks, arising in a comparatively short time interval can be avoided, thus leading to an increase in the fatigue strength under short-time vibratory stresses and effectively reducing the occurrence of cracks or the growth of cracks in the blade material.

The invention claimed is:

1. A hollow internally cooled gas turbine engine blade, comprising:

an inner blade platform arranged at an inner end of the blade and forming an inner boundary of an annular hot-gas duct of a gas turbine engine;

an outer blade platform arranged at an outer end of the blade and forming an outer boundary of the annular hot-gas duct of the gas turbine engine;

a hollow blade profile that extends between the inner and outer blade platforms, the blade profile arranged within a working medium flow path of the gas turbine engine;

an onflow edge arranged at an up-stream portion of the hollow blade profile relative to a working fluid direction of flow;

an onflow edge duct arranged within the hollow blade profile in the onflow edge portion; and a heating element arranged within the onflow edge duct that extends substantially over an entire length of the onflow edge duct.

2. The gas turbine guide blade as claimed in claim 1, wherein the heating element is in intimate contact with the onflow duct wall or is partially integral within the duct wall.

3. The gas turbine guide blade as claimed in claim 1, wherein the heating element is an electrical heating element.

4. The gas turbine guide blade as claimed in claim 3, wherein the electrical heating element is an electrical helical heating coil.

5. The gas turbine guide blade as claimed in claim 1, wherein the blade has a plurality of internal cooling cavities and the heating element is arranged in a cavity adjacent to the onflow edge duct.

6. The gas turbine guide blade as claimed in claim 1, wherein a cooling medium flows through the onflow edge duct.

7. The gas turbine guide blade as claimed in claim 1, wherein the blade is a guide blade.

* * * * *